US008894363B2

(12) United States Patent
Lee et al.

(10) Patent No.: US 8,894,363 B2
(45) Date of Patent: Nov. 25, 2014

(54) COOLING MODULE DESIGN AND METHOD FOR COOLING COMPONENTS OF A GAS TURBINE SYSTEM

(75) Inventors: Ching-Pang Lee, Cincinnati, OH (US); Humberto A. Zuniga, Casselberry, FL (US); Jay A. Morrison, Titusville, FL (US); Brede J. Kolsrud, Cedar Rapids, IA (US); John J. Marra, Winter Springs, FL (US)

(73) Assignees: Siemens Energy, Inc., Orlando, FL (US); Mikro Systems, Inc., Chrlottesville, VA (US)

( * ) Notice: Subject to any disclaimer, the term of this patent is extended or adjusted under 35 U.S.C. 154(b) by 922 days.

(21) Appl. No.: 13/023,716

(22) Filed: Feb. 9, 2011

(65) Prior Publication Data

US 2012/0201674 A1 Aug. 9, 2012

(51) Int. Cl.
*F01D 5/18* (2006.01)

(52) U.S. Cl.
CPC ..... *F01D 5/186* (2013.01); *F01D 5/187* (2013.01); *F05D 2230/51* (2013.01); *F05D 2240/40* (2013.01)
USPC ..... 415/175; 415/178; 416/96 R; 416/97 R

(58) Field of Classification Search
CPC ..... F01D 5/18; F01D 5/181; F01D 5/182; F01D 5/183; F01D 5/184; F01D 5/186; F01D 5/187; F01D 25/08; F01D 25/12; F01D 25/14
USPC ..... 415/1, 175, 176, 177, 178, 180, 182.1; 416/90 R, 95, 97 R, 97 A, 96 A, 232
See application file for complete search history.

(56) References Cited

U.S. PATENT DOCUMENTS

| | | | | |
|---|---|---|---|---|
| 5,370,499 | A | 12/1994 | Lee | |
| 5,503,529 | A | 4/1996 | Anselmi et al. | |
| 5,511,946 | A | 4/1996 | Lee et al. | |
| 6,179,565 | B1 | 1/2001 | Palumbo et al. | |
| 6,325,593 | B1 | 12/2001 | Darkins, Jr. et al. | |
| 6,379,118 | B2 | 4/2002 | Lutum et al. | |
| 6,402,470 | B1 | 6/2002 | Kvasnak et al. | |
| 6,652,235 | B1 | 11/2003 | Keith et al. | |
| 6,981,840 | B2 | 1/2006 | Lee et al. | |
| 7,114,923 | B2 | 10/2006 | Liang | |
| 7,186,084 | B2 | 3/2007 | Bunker et al. | |
| 8,388,300 | B1 * | 3/2013 | Liang | 415/1 |
| 2006/0096293 | A1 * | 5/2006 | Norris et al. | 60/776 |
| 2006/0099074 | A1 * | 5/2006 | Kopmels | 416/97 R |
| 2008/0279696 | A1 * | 11/2008 | Liang | 416/97 R |
| 2009/0274549 | A1 * | 11/2009 | Mitchell et al. | 415/115 |

* cited by examiner

*Primary Examiner* — Christopher Vedier

(57) ABSTRACT

A cooling arrangement in a gas turbine system (120). The arrangement includes a plurality of flow network units (208) to transfer heat to cooling fluid, at least one unit including first (218), second (220), and third (222) flow sections between openings (64*a*) in a first wall (66) and an opening in a second wall (68) to pass cooling fluid through the walls. The first section includes first flow paths, between the openings in the first wall and the second section, extending to the second section. The third section includes third flow paths, between the second section and the opening in the second wall, to effect flow of cooling fluid. The second section includes one or more cooling fluid flow paths between the first section and the third section. The number of flow paths in the second section is fewer than the number of first flow paths and fewer than the number of third flow paths.

12 Claims, 10 Drawing Sheets

COOLING MODULE DESIGN AND METHOD FOR COOLING COMPONENTS OF A GAS TURBINE SYSTEM

CROSS REFERENCE TO RELATED APPLICATIONS

This application relates to co-pending application Ser. No. 12/832,124 filed on 8 Jul. 2010 titled "Meshed Cooled Conduit for Conveying Combustion Gases" and co-pending application Ser. No. 12/908,029 filed on 20 Oct. 2010 titled "Airfoil Incorporating Tapered Cooling Structures Defining Cooling Passageways" and co-pending application Ser. No. 12/765,004 filed 22 Apr. 2010 titled "Discreetly Defined Porous Wall Structure for Transpirational Cooling."

FIELD OF THE INVENTION

The present invention relates to gas turbine engines and, more particularly, to a cooling passage disposed within a component of a gas turbine system.

BACKGROUND OF THE INVENTION

A typical gas turbine engine includes a fan, compressor, combustor, and turbine disposed along a common longitudinal axis. Fuel and compressed air discharged from the compressor are mixed and burned in the combustor. The resulting hot combustion gases (e.g., comprising products of combustion and unburned air) are directed through a conduit section to a turbine section where the gases expand to turn a turbine rotor. In electric power applications, the turbine rotor is coupled to a generator. Power to drive the compressor may be extracted from the turbine rotor.

The one or more conduits forming the conduit section are liners or transition ducts through which the hot combustion gases flow from the combustion section to the turbine section. Due to the high temperature of the combustion gases, the conduits must be cooled during operation of the engine in order to preserve the integrity of the components. Commonly, the combustor and turbine components are cooled by air which is diverted from the compressor and channeled through the components.

Known solutions for cooling the conduits include supplying the cool air along an outer surface of the conduit to provide direct convection cooling to the transition duct. An impingement sleeve may be provided about the outer surface of the conduit to facilitate flow of the cooling fluid, e.g., through small holes formed in an impingement member before the air is introduced to the outer surface of the conduit. Other prior art solutions include injecting the cooling fluid along an inner surface of the conduit to provide film cooling along the inner surface.

Effective cooling of turbine components, e.g., airfoils, must deliver the relatively cool air to critical regions such as along the trailing edge of a turbine blade or a stationary vane. The associated cooling apertures may, for example, extend between an upstream, relatively high pressure cavity and one of the exterior surfaces of the turbine blade. It is a desire in the art to provide cooling designs and methods which provide more effective cooling with less air. It is also desirable to provide more cooling in order to operate machinery at higher levels of power output. Generally, cooling schemes should provide greater cooling effectiveness to create more uniform wall temperatures along the components.

Ineffective cooling can result from poor heat transfer characteristics between the cooling fluid and the material to be cooled with the fluid. In many cases, it is desirable to establish film cooling along a wall surface. A cooling air film traveling along the surface of a wall can be an effective means for increasing the uniformity of cooling and for insulating the wall from the heat of hot core gases flowing thereby. However, film cooling is difficult to maintain in the turbulent environment of a gas turbine.

Also, gaps which exist between apertures and in areas immediately downstream of the gaps, are exposed to less cooling air than are the apertures and the surface areas immediately downstream of the apertures. Consequently these regions are more susceptible to thermal degradation.

BRIEF DESCRIPTION OF THE DRAWINGS

The invention will be better understood from the following description when read in conjunction with the accompanying drawings in which like reference numerals identify like elements throughout and wherein.

DETAILED DESCRIPTION OF THE INVENTION

Figure 1A:
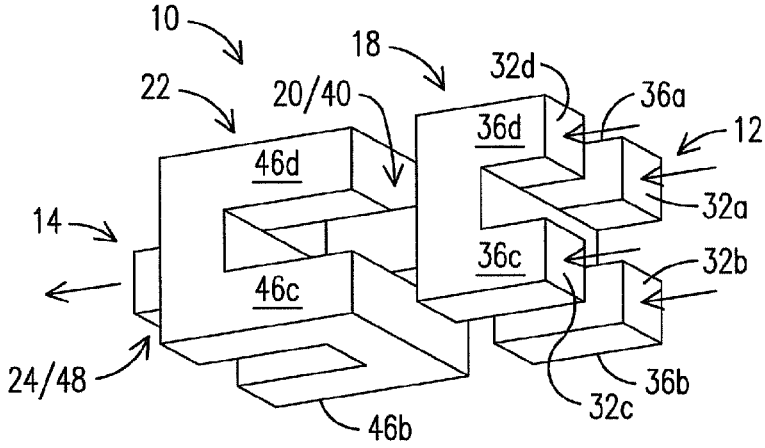
FIGS. 1A-1C are perspective views of a cooling module unit according to an embodiment of the invention.
Figure 1B:
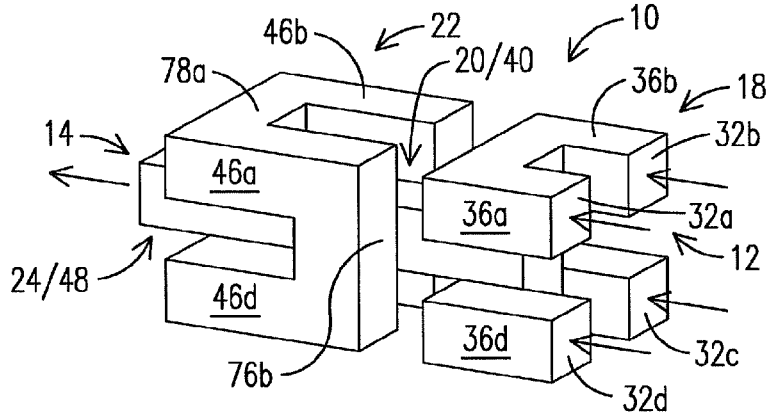
Figure 1C:
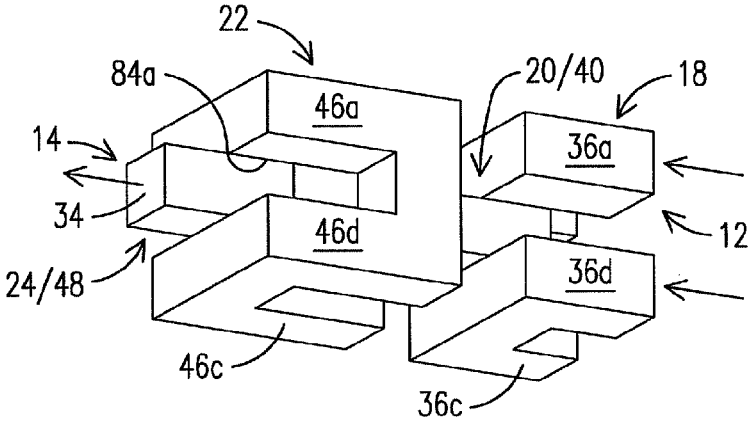
Figure 1D:
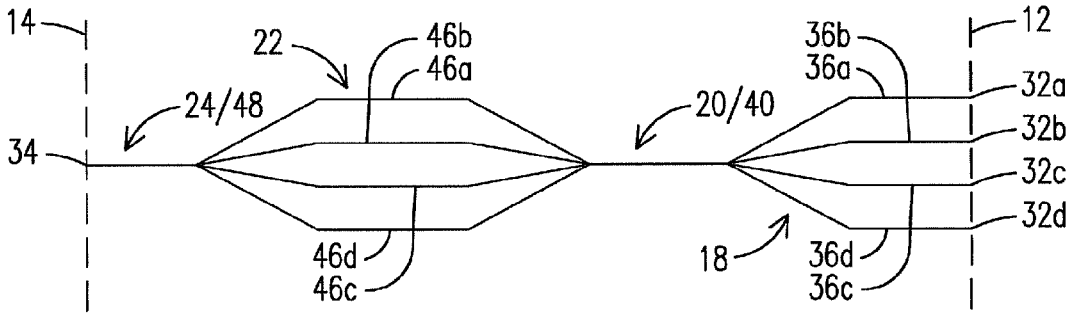
FIG. 1D is a schematic illustration of the connections between chambers of sections in the module shown in FIGS. 1A-1C.
Figure 2A:
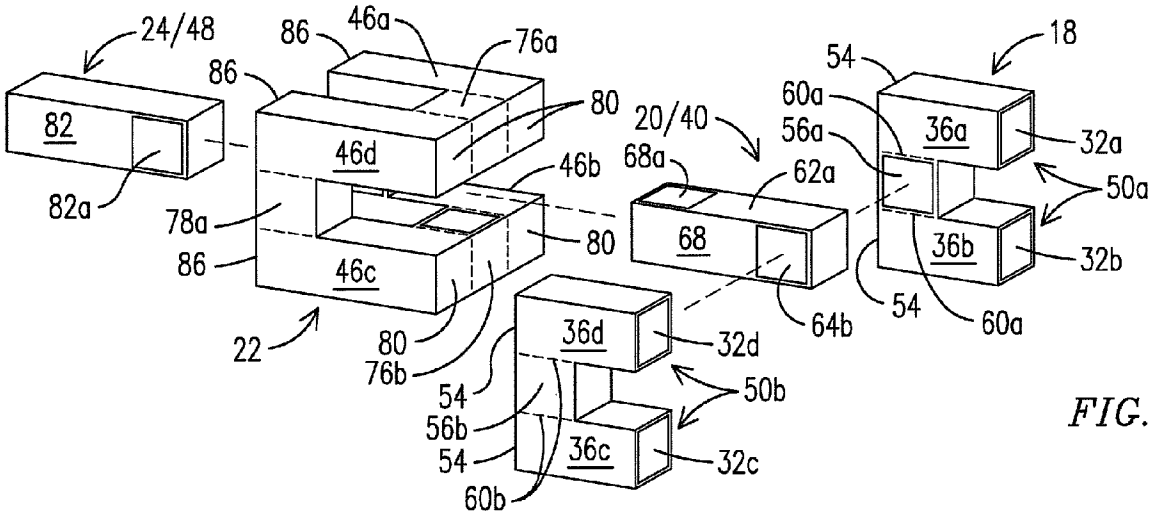
FIGS. 2A-2D are exploded views of sections of the module shown in FIGS. 1A-1D.
Figure 2B:
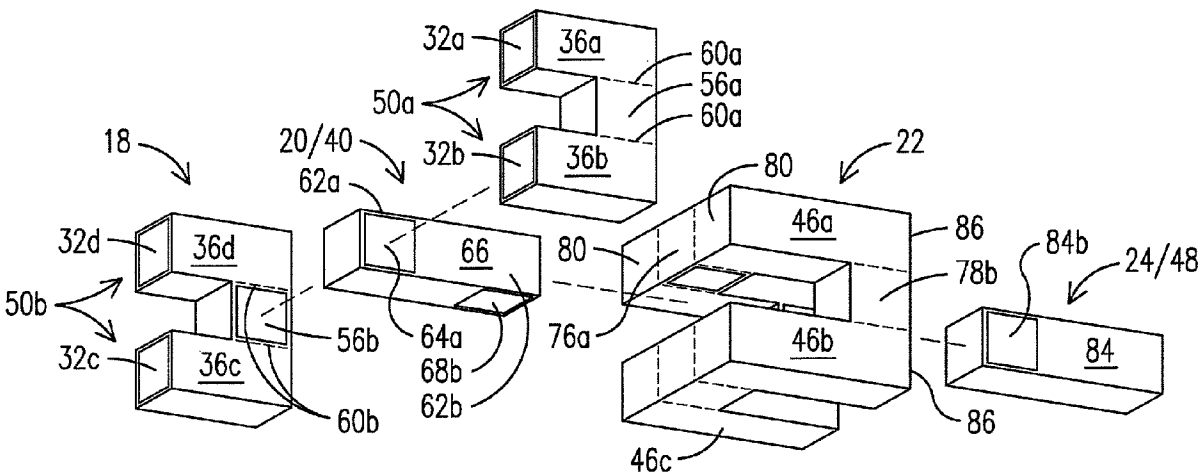
Figure 2C:
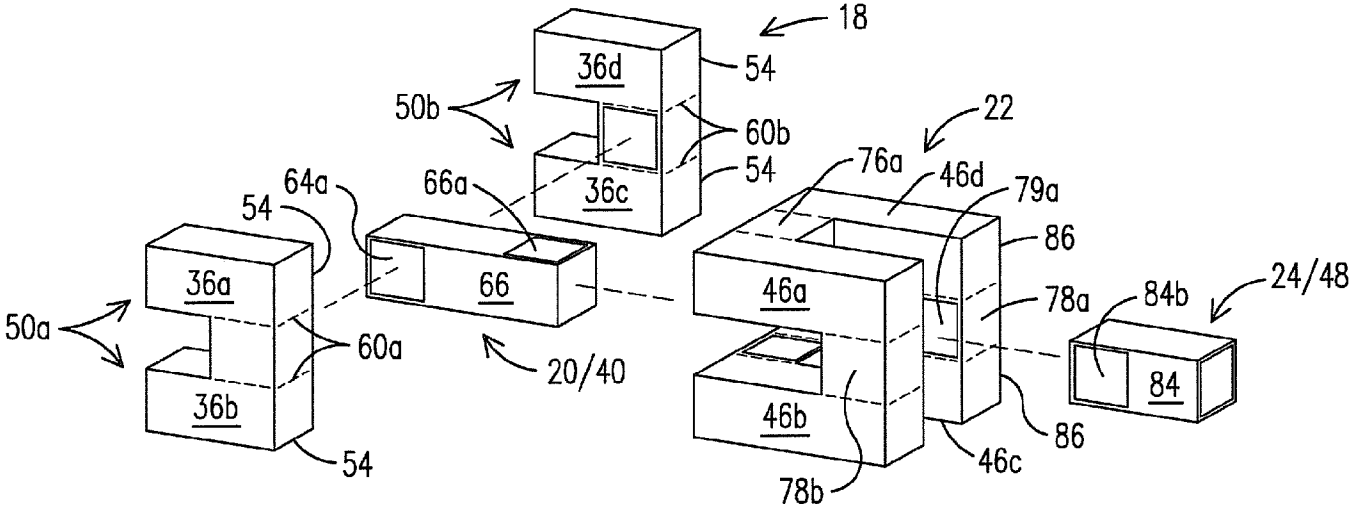
Figure 2D:
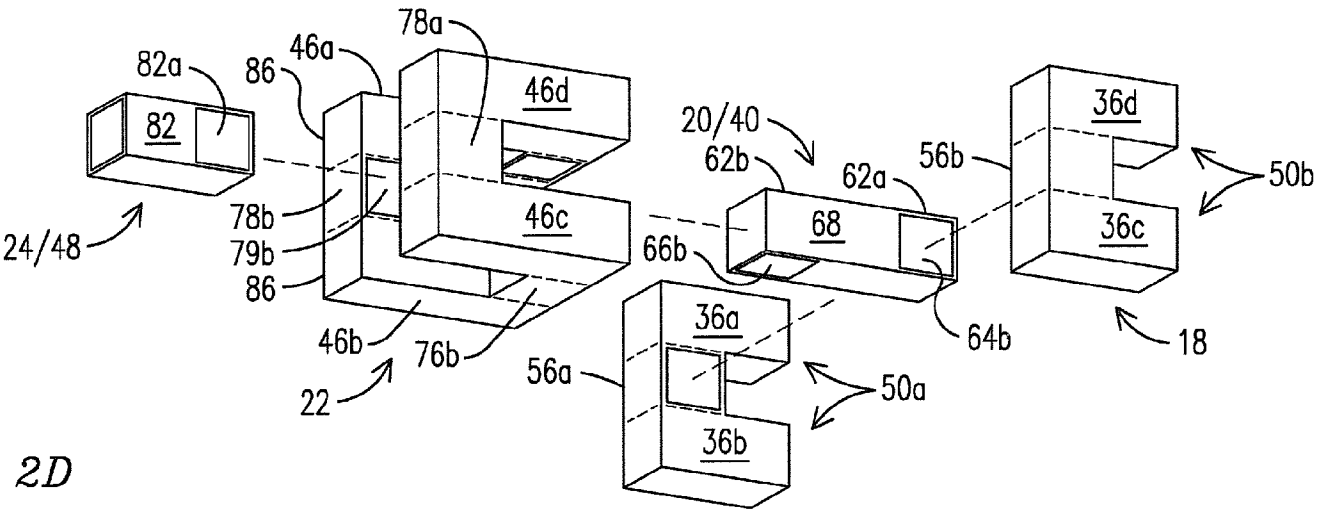

With reference to the perspective views of FIGS. 1A-1C there is shown a cooling module 10 suitable for formation within a wall of a component of a gas turbine power generation system. This and other modules according to the invention include a series of interconnected flow sections wherein chambers in each section are each connected to one or more chambers in another flow section to enable passage of cooling fluid through all of the sections. The example module 10 includes first, second, third and fourth flow sections 18, 20, 22 and 24 extending between first and second opposing sides 12 and 14. In this embodiment the first side 12 corresponds to one side of the first flow section 18 along which one or more input ports 32 are formed, and the second side 14 corresponds to one side of the fourth flow section 24 along which one or more output ports 34 are formed. The module 10 includes four input ports 32*a*, 32*b*, 32*c* and 32*d*, each providing flow into a different one of four chambers 36*a*, 36*b*, 36*c* and 36*d*, formed in the first flow section 18. Each of the four chambers 36 is connected to pass the cooling fluid to a single chamber 40 formed in the adjoining second flow section 20. In turn the chamber 40 is connected to pass the received fluid to four chambers 46*a*, 46*b*, 46*c* and 46*d* formed in the adjoining third flow section 22. Each of the four chambers 46*a*, 46*b*, 46*c* and 46*d* is connected to pass the cooling fluid to a single chamber 48 formed in the adjoining fourth flow section 24. The afore-described arrangement of chambers is functionally illustrated in the simplified schematic diagram of FIG. 1D.

The cooling module 10 may be formed in a casting process from, for example, a ceramic core, although other suitable materials may be used. A suitable process for fabrication is available from Mikro Inc., of Charlottesville Va. See, for example, U.S. Pat. No. 7,141,812 which is incorporated herein by reference. For the embodiment illustrated in the figures, the flow sections 18, 20, 22 and 24 may be integrally formed with one another in such a casting process. As further illustrated herein, multiple cooling modules can be integrally formed in such a casting process to create a series of cooling modules, e.g., extending in one or two dimensions along the interior of a wall. For purposes of describing features of the illustrated embodiments, the chambers in each flow section are shown as rectangular-shaped volumes formed with pairs of parallel opposing walls, but the various chambers and sections many be formed with many other geometries and the cross sectional shapes and sizes of the various sections may vary, for example, to meter the flow of cooling fluid.

With reference to FIGS. 2A-2D, the flow section 18 comprises two pairs 50*a* and 50*b* of the chambers 36. The cooling fluid enters the input port (32*a*, 32*b* or 32*c*, 32*d*) of each chamber (36*a*, 36*b*, 36*c*, 36*d*) and then flows to a distal end 54 of the chamber. With respect to the pair 50*a* of chambers 36 (36*a*, 36*b*), at the distal ends 54 each of the chambers 36 merges into a transition chamber portion 56*a*. The combination of the pair 50*a* of chambers 36 (36*a*, 36*b*) and the transition chamber portion 56*a* connecting the pair of chambers is illustrated in the figures as a "U" shape configuration. Similarly, with respect to the pair 50*b* of chambers 36 (36*c*, 36*d*), at the distal ends 54 each of the chambers 36 (36*c*, 36*d*) merges into a transition chamber portion 56*b*. The combination of the pair 50*b* of chambers 36*c* and 36*d* and the transition chamber portion 56*b* connecting the pair of chambers is also illustrated in the figures as a "U" shape configuration.

Opposing end portions 60*a* of the transition chamber portion 56*a* connect to different chambers 36*a* and 36*b* in the pair 50*a* of chambers 36. An opening in the transition chamber portion 56*a* further connects to a first end 62*a* of first and second opposing ends 62*a*, 62*b* of the chamber 40 of the flow section 20. Connection is effected through an opening 64*a* in a first wall 66 of first and second opposing walls 66, 68 of the flow section 20. The opening 64*a* provides a first path for the cooling fluid to enter into the chamber 40 of the flow section 20. Similarly, opposing end portions 60*b* of the transition chamber portion 56*b* connect to different chambers 36*c*, 36*d* in the pair 50*b* of chambers 36 while the transition chamber portion 56*b* further connects to the first end 62*a* of the chamber 40 of the flow section 20. Connection is effected through an opening 64*b* in a second wall 68 of first and second opposing walls 66, 68 of the chamber 40 of the flow section 20. The opening 64*b* provides a second path for the cooling fluid to enter into chamber 40 of the flow section 20.

With the flow section 20 having a second end 62*b* of first and second opposing ends 62*a*, 62*b*, and the pair of openings 64*a* and 64*b* positioned at the first end 62*a* thereof, second openings 68*a* and 68*b* are positioned at the second end 62*b* to connect the chamber 40 to chambers 46 in the section 22.

The flow section 22 comprises four chambers 46*a*, 46*b*, 46*c* and 46*d*, first and second spaced-apart transition chambers 76*a* and 76*b* and third and fourth spaced-apart transition chambers 78*a* and 78*b*. A first end 80 of each of the chambers 46*a* and 46*d* merges into the transition chamber 76*a*. The combination of the chambers 46*a* and 46*d* and the transition chamber 76*a* connecting the chambers 46*a* and 46*d* is illustrated in the figures as a "U" shape configuration. The chambers 46*a* and 46*d* each connect to the transition chamber 76*a* at a different opposing end of the transition chamber 76*a* while the second opening 68*a* of the flow section 20 transitions into the transition chamber 76*a*.

Similarly, with respect to the chambers 46*b* and 46*c*, a first end 80 of each of the chambers 46*b* and 46*c* merges into transition chamber 76*b*. The combination of the chambers 46*b* and 46*c* and the transition chamber 76*b* connecting the chambers 46*b* and 46*c* is also illustrated in the figures as a "U" shape configuration. The chambers 46*b* and 46*c* each connect to the transition chamber 76*b* at a different opposing end of the transition chamber 76*b* while the second opening 68*b* of the flow section 20 transitions into the transition chamber 76*b*.

The transition chambers 78*a* and 78*b* are each connected to the chamber 48 along first and second opposing walls 82 and 84 of the flow section 24. Second ends 86 of each of the chambers 46*c* and 46*d* merge into the transition chamber 78*a*. The combination of the chambers 46*c* and 46*d* and the transition chamber 78*a* connecting the pair of chambers 46*c* and 46*d* is illustrated in the figures as a "U" shape configuration. The chambers 46*c* and 46*d* each connect to the transition chamber 78*a* at a different opposing end of the transition chamber 78*a*.

An opening 79*a* in the transition chamber 78*a* connects to an opening 82*a* in the first wall 82 of the chamber 48 to provide a path for cooling fluid to pass into the flow section 24.

Second ends 86 of each of the chambers 46*a* and 46*b* merge into the transition chamber 78*b*. The combination of the chambers 46*a* and 46*b* and the transition chamber 78*b* connecting the pair of chambers 46*a* and 46*b* is also illustrated in the figures as a "U" shape configuration. The chambers 46*a* and 46*b* each connect at a different opposing end of the transition chamber 78*b*. An opening 79*b* in the transition chamber 78*b*, connects to an opening 84*b* through the second wall 84 of the chamber 48 to provide another path for cooling fluid to pass into the flow section 24.

Having described one embodiment of a cooling module it will be apparent that the flow of cooling fluid, such as indicated in FIGS. 1A-1C with arrows, can enter the module 10 at one side 12 and exit the module at the other side 14; and that the number of flow sections and the number of parallel chambers in each flow section can be modified based on design considerations. In many applications it is desirable to form the modules 10 in arrays. A variety of inventive array configurations provide for flow of cooling fluid through or within the walls of components in gas turbine power generation systems. The modules 10 may be formed in one, two or three dimensional arrays. Individual members in these arrays may be built up from smaller blocks of arrays in a variable manner, such that members of the arrays may differ from one another or may have various patterns of similarity depending on the topology of the item to be cooled. According to one example application, a two dimensional array is suitable for controlling temperature along the surface of a conduit through which hot combustion gases travel from a combustor toward a turbine section. In another application, an array of the modules is configured in a series to flow cooling fluid within the walls of an airfoil portion of a stator vane or a rotor blade. The series may comprise a stack of like modules or a stack of multiple different modules, e.g., where rows in the stack comprise modules arranged in series so that, for modules in a row of the stack, cooling fluid can flow through one module and then through one or more additional modules. In other embodiments the arrays can include combinations of series and parallel paths for the cooling fluid.

Figure 3A:
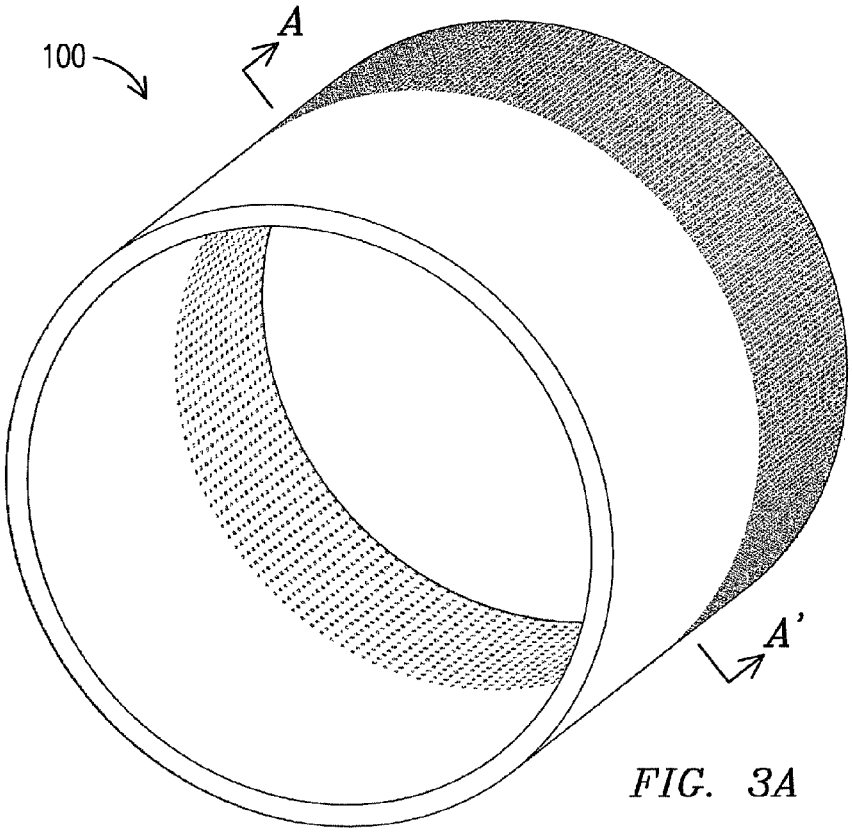
FIG. 3A is a perspective view of a section of conduit incorporating the module of FIGS. 1 and 2 for transmitting a flow of cooling fluid in a turbine duct.
Figure 3B:
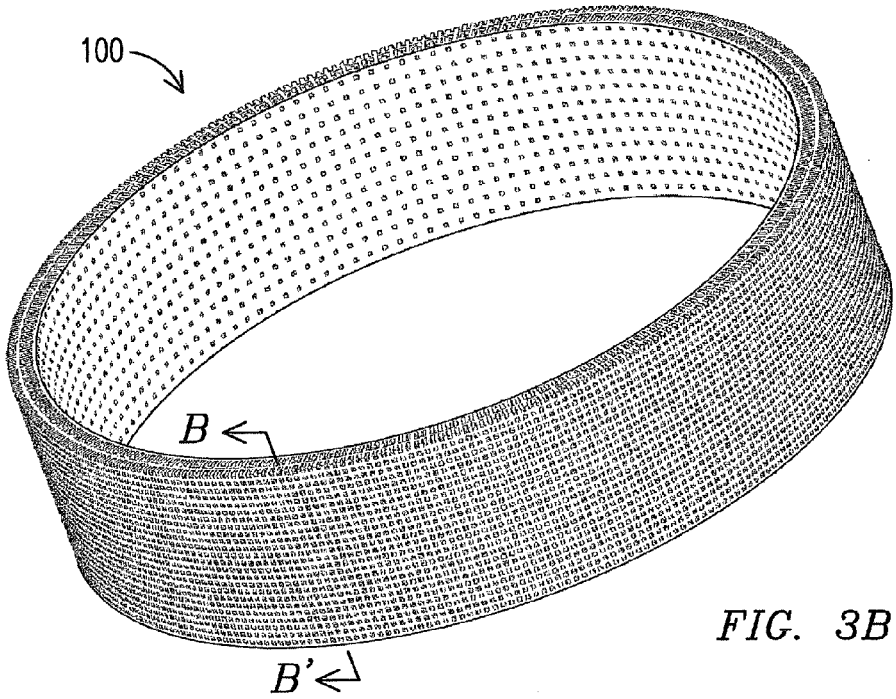
FIG. 3B is a partial cut-away view of the conduit section shown in FIG. 3A.
Figure 3C:
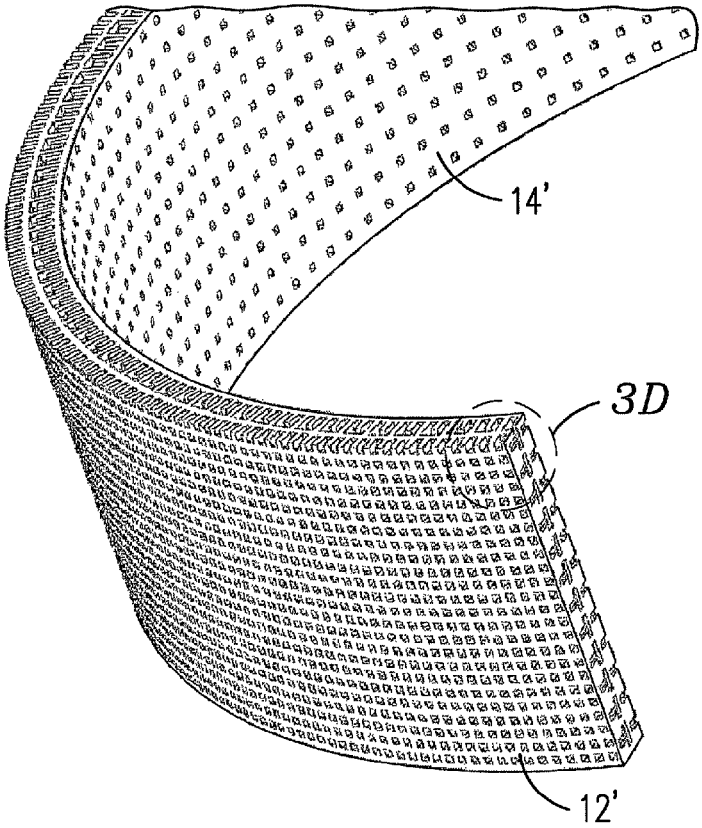
FIG. 3C is another partial cut-away view of the conduit section shown in FIG. 3A.
Figure 4A:
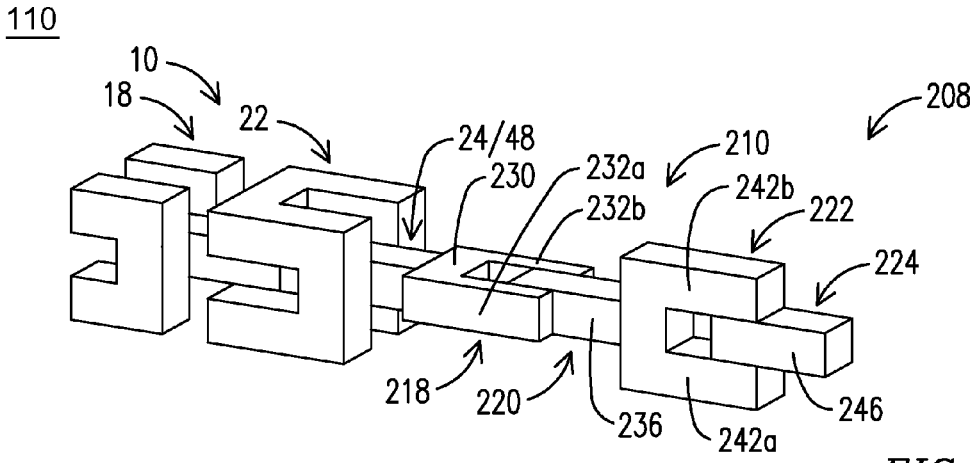
FIGS. 4A and 4B are perspective views illustrating two embodiments of a series of modules arranged to provide flow of cooling fluid along the interior of an airfoil.
Figure 4B:
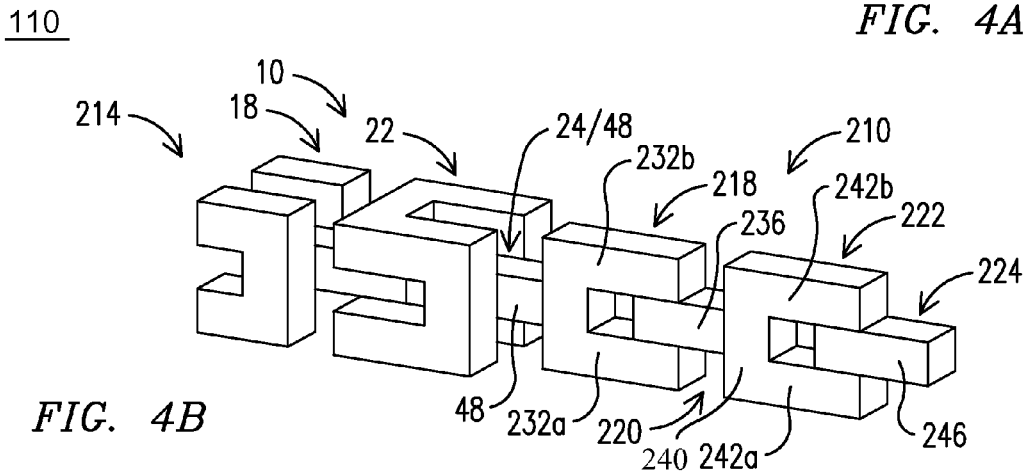
Figure 4C:
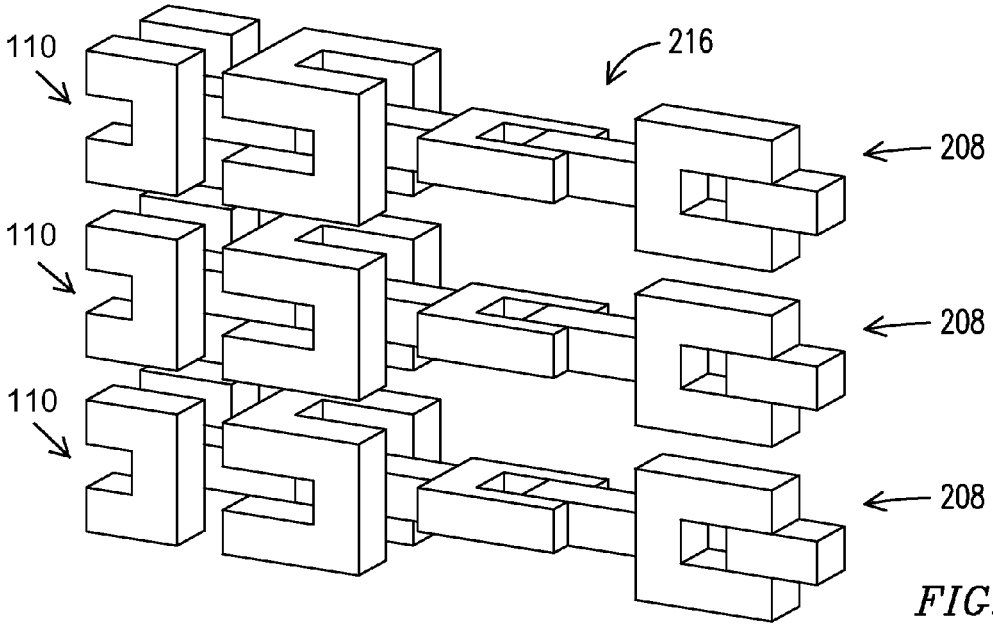
FIG. 4C is a partial elevation view of an array of the modules shown in FIG. 4A wherein the modules are stacked in a vertical direction.

FIG. 3A illustrates a conduit section 100 formed as a two dimensional array of the cooling modules 10. FIGS. 4A-4C are views of another array, formed as a series 110 of modules (including the module 10). The modules can be arranged to provide a serial flow of cooling fluid within the walls of an airfoil, e.g., a turbine blade, shown in FIG. 4D.

Figure 5:
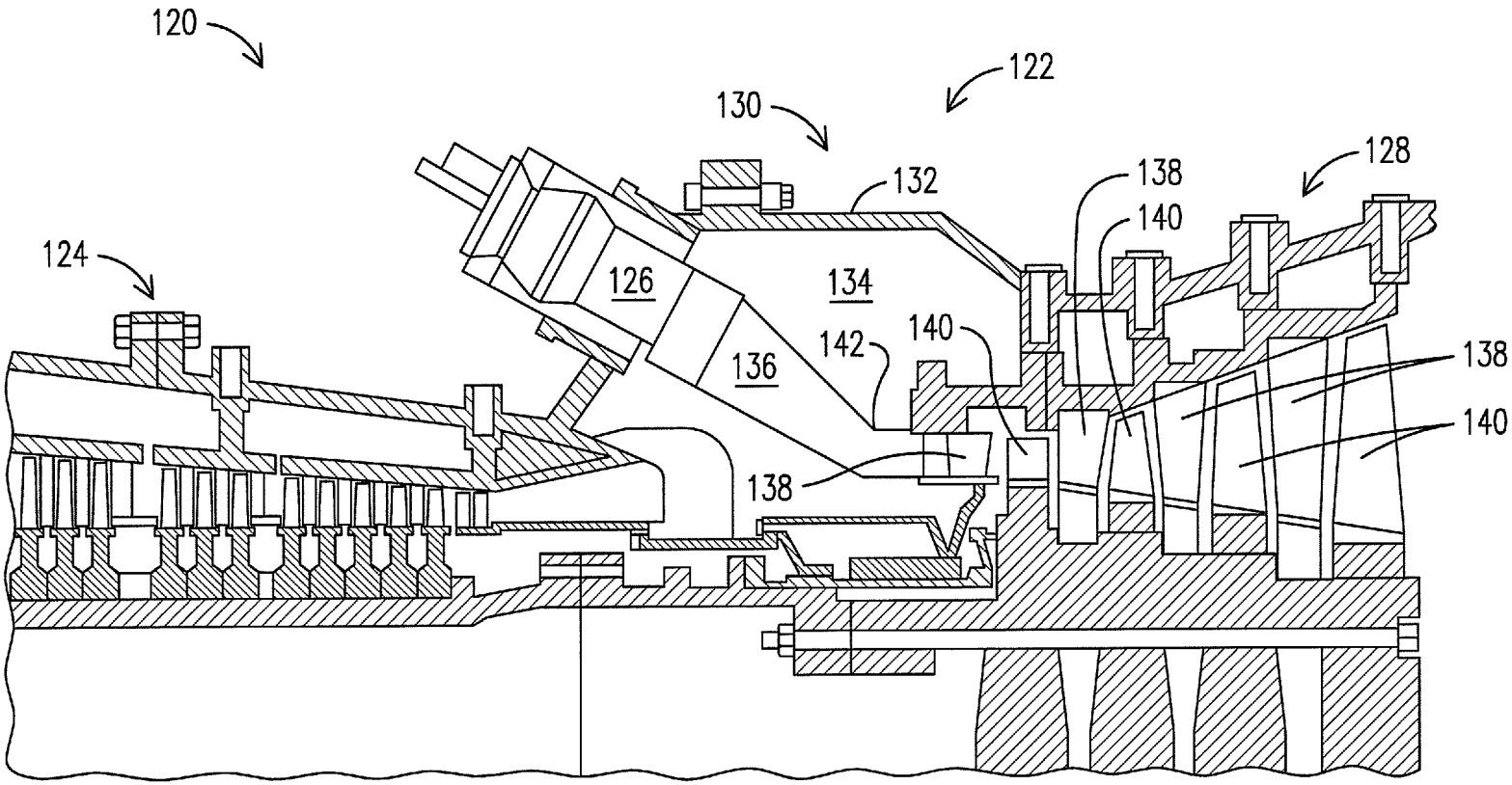
FIG. 5 is a simplified schematic diagram illustrating a cross sectional view of a portion of a gas turbine power generation system incorporating embodiments of the invention.

FIG. 5 is a schematic illustration of a portion of a gas turbine power generation system 120 taken in cross section. The system 120 incorporates arrays of cooling modules according to the invention, including conduit sections 100 and the series 110. A gas turbine engine 122 of the system 120 includes a compressor 124 which feeds air to a combustion chamber 126 and a turbine 128 which receives hot exhaust gas from the combustion chamber. A mid-frame section 130, disposed between the compressor 124 and the turbine 128, is defined in part by a casing 132 formed about a plenum 134 in which the combustion chamber 126 (e.g., shown as a can-annular combustor) and a transition exhaust duct 136 are situated. During operation the compressor 124 provides compressed air to the plenum 134 through which the compressed air passes to the combustion chamber 126, where the air is mixed with fuel (not shown). Combusted gases exiting the combustion chamber 126 travel through the transition exhaust duct 136, which serves as a conduit; to the turbine 128. The turbine provides rotation which turns an electric generator (not shown). The plenum 134 is an annular chamber that holds a plurality of circumferentially spaced apart combustion chambers 126 each associated with a downstream transition exhaust duct 136 through which hot exhaust gases pass toward the turbine 128. The turbine 128 comprises a series of stationary vanes 138 and rotatable blades 140 along which the hot exhaust gases flow.

The combustion chamber 126, and other components (e.g., vanes and blades) along which the hot exhaust gases flow, are cooled to counter the high temperature effects which the hot exhaust gases would otherwise have on component materials. Commonly, at least the initial blade stages within the turbine 128 are cooled using air bled from various stages of the compressor 124 at a suitable pressure and temperature to effect flow of cooling fluid along exterior surfaces of materials which are in the path of the hot exhaust gases. For example, a plurality of cooling apertures may be formed through pressure and suction sidewalls of the blade. Conventionally, cooling fluid which flows through the base of the blade to the airfoil portion may follow a serpentine path within the airfoil to reach the apertures. Once the fluid exits the blade interior through the apertures it flows along exterior surface regions on both the pressure side and the suction side of the blade. For further details see U.S. Pat. No. 5,370,499 which is incorporated herein by reference.

According to numerous embodiments of the invention, a variety of cooling module arrays are disposed within the walls of different components positioned along the path of the hot exhaust gases. Thermal energy is transferred from the walls to cooling fluid which passes through modules in the arrays. One or more arrays of the modules can be disposed in any wall that requires cooling, e.g., walls for which temperature must be limited to preserve the integrity of the associated component.

In one example application of the invention, the modules 10 network units in an array formed within walls of multiple modular conduit sections 100 which are assembled to provide the transition exhaust ducts 136 for the system 120 shown in FIG. 5. The exemplary conduit section 100, shown in FIG. 3A, is one in a plurality of like sections which are coupled together to form a straight section of a transition duct 136. Although not illustrated herein, it is to be understood that modified conduit sections can be configured according to the principles of the invention to effect bends in the transition duct, such as the bend 142 of the transition duct 136 shown in FIG. 5.

With further reference to FIG. 3, the exemplary conduit section 100 is in the shape of a regular cylinder. FIG. 3B is a partial cut-away view of the conduit section 100 taken along line A-A' of FIG. 3A taken through the chambers 36*a*, 36*d*, 46*a* and 46*d* shown in FIG. 1B. FIG. 3C is another partial cut-away view of the conduit section 100 taken through the chambers 40 and 48 shown in FIG. 1C and again illustrating the chambers 36*a*, 36*d*, 46*a* and 46*d* shown in FIG. 3B. See, also, FIG. 3D which provides an enlarged view of a portion of the conduit section in a region 150 of FIG. 3C, taken along the exposed portions of the chambers 36*a*, 36*d*, 46*a*, 46*d*, 40 and 48, further illustrating details of exemplary flow paths for cooling fluid. In this arrangement, the cooling fluid enters the array 100 from sides 12 of individual modules 10 and exits the array from sides 14 of the modules 10 (as described with reference to FIGS. 1A-1D). Generally, the modules 10 of the array 100 can be arranged in rows and columns. Transition exhaust ducts 136, and turbine exhaust ducts generally, can be assembled with multiple conduit sections 100, each forming a section of the duct. Each of the sections 100 transmits a flow of cooling fluid in a radial direction inward from outside the exhaust duct 136 and into the flow of hot exhaust gases within the conduit or duct 136, i.e., with respect to the axial flow of exhaust gases, through the walls of the exhaust duct. In other embodiments, the modules 10 may be configured to transmit the cooling fluid through the modules in predominately axial directions, i.e., predominantly along the direction of exhaust gas flow relative to flow across the walls of the exhaust duct. That is, multiple other array configurations may be had with inlets and outlets arranged along inside and outside walls of the exhaust duct to pass the cooling fluid along the axial direction of exhaust flow through the duct while also exiting into the exhaust duct.

The views of FIG. 3 illustrates an exterior wall surface 12' and an interior wall surface 14' of the conduit section 100. The sides 12 of the cooling modules 10 are formed along the wall surface 12' with openings corresponding to the input ports 32*a*, 32*b*, 32*c* and 32*d* formed along the wall surface 12'.

The sides 14 of the cooling modules 10 are formed along the wall surface 14' with openings corresponding to the output ports 34 of the modules 10. With this array configuration the net flow of cooling fluid is predominantly in the radial direction relative to axial flow of hot exhaust gases through the conduit section 100.

Figure 3D:
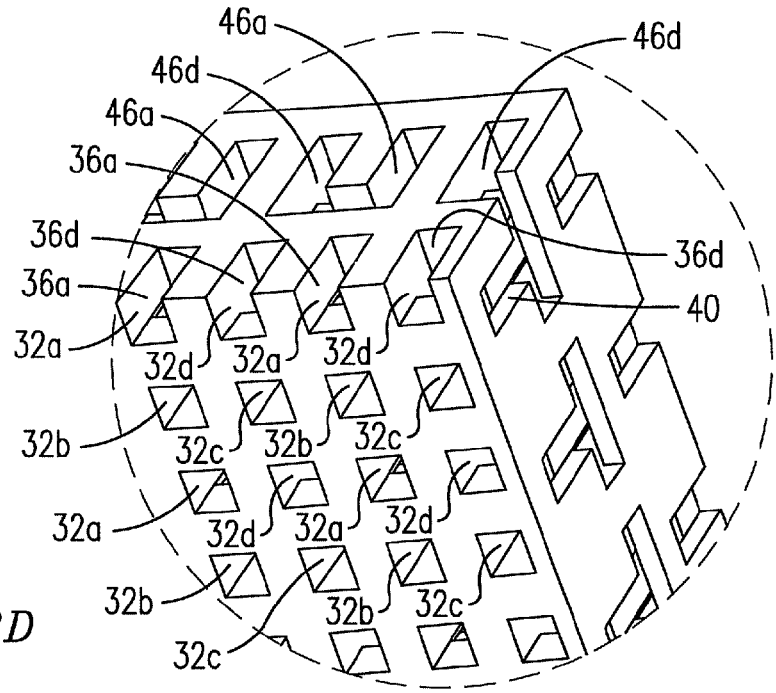
FIG. 3D is an enlarged view of a portion of a region of the conduit section shown in FIG. 3C.

FIG. 3D illustrates a cut-away view along a radial direction of the modular conduit section 100, showing portions of paths through the array of modules 10. The view of FIG. 3D exposes a chamber 36*d* associated with an inlet 32*d* of the module 10, as well as the intermediate chambers 40 and 46*d* and the chamber 48 leading to the outlet port 34 along the side 14' of the section 100.

A feature of embodiments of the invention so far described is that each of the cooling modules in a conduit section 100 provides a set of paths wherein cooling fluid may flow in a radial direction (e.g., through module sections 18 and 20), a longitudinal direction i.e., along the direction of flow of the exhaust gas (e.g., traveling through the transition ducts 136 from transition chambers 56*a*, 56*b* of module sections 18, through openings 64*a* or 64*b* and into the chamber 40; and travelling from transition chambers 78*a* and 78*b* of module sections 22, through openings 82*a* or 84*b* and into chambers 48 of sections 24), a circumferential direction (e.g., travelling from chambers 46*a*-46*d* and through transition chambers 78*a* and 78*b* of module sections 22) and in a radial direction again (e.g., travelling through chambers 48 of module sections 24 to the output ports 34). Thus with the conduit section 100 formed with an array of the modules 10, there can be a sequence of flow directions comprising radial, longitudinal, radial, longitudinal, radial, longitudinal and radial directions, each corresponding to flow through a different chamber or between chambers.

In a second example application of the invention, the modules 10 are formed as an array of network units within walls of an airfoil to provide interior flow paths for cooling fluid. In embodiments according to the second example, the modules of different designs are formed in combination to provide module sections. FIG. 4A illustrates one exemplary module section or unit 208, comprising the module 10 and a second module 210. Although shown as distinct modules, it is to be understood that the modules 10 and 210 can be integrally formed as one monolithic unit in a casting process. Further, a vertical array of such units can be created to line the interior of the airfoil. FIG. 4B illustrates another module section or unit 214, comprising the module 10 and the second module 210 wherein the second module is rotated ninety degrees relative to the orientation shown in FIG. 4A.

FIG. 4C is an elevation view of part of an array 216 of the units 208, with each unit comprising the modules 10 and 210 shown in FIG. 4A. The modules are stacked in a vertical direction as they would be positioned within the portion of an airfoil near the trailing edge as will be described with reference to FIG. 4D. Another feature of the invention, particularly relevant to applications within the walls of an airfoil, is that of combining modules (e.g., modules 10 and 210) into module sections which are repeatable units in an array. The sections can be stacked or otherwise assembled into larger arrays having geometries tailored to specific characteristics of the structure being cooled. Variable blade thickness, e.g., between the leading and trailing edges of the blade, is an exemplary design parameter leading to selection of the module configuration shown in FIG. 4A. Similarly, for the transition ducts 136 shown in FIG. 5, modules or sections comprising multiple modules can be configured to accommodate variable curvature.

The module 210 is now briefly described. It is to be understood that, like the module 10, the module 210 includes a series of sections that each comprise one or more chambers for serial or parallel flow of cooling fluid therethrough. Also, like the module 10 and numerous other embodiments of modules according to the invention, alternate sections of the module 210 include a transition chamber connected to a pair of chambers. The transition chamber and the pair of chambers are in a "U" shape configuration to effect parallel flow of cooling fluid through the pair of chambers. To the extent that details of connections (e.g., via openings in walls of chambers) between chambers in the module 210 are not described, it will be understood that such connections can be effected in a manner similar to the connections described for the module 10.

The module 210 has a first, second, third and fourth module sections 218, 220, 222 and 224. The first section 218 comprises one transition chamber 230 coupled to receive cooling fluid from the chamber 48 of the section 24 of the first module 10. The first section 218 further includes two parallel chambers 232*a* and 232*b* each connected at a different end of the transition chamber 230 to receive cooling fluid from the transition chamber 230 for parallel flow of cooling fluid through the chambers 232*a* and 232*b*. The second section 220 comprises a single chamber 236 coupled at a first of two opposing ends thereof to receive cooling fluid from the two parallel chambers 232*a* and 232*b*. A second end of the second chamber 236 is coupled to send the received cooling fluid into a transition chamber 240 of the third section 222. The third section 222 further includes two parallel chambers 242*a* and 242*b*, each connected at a different end of the transition chamber 240 to receive cooling fluid from the transition chamber 240 for parallel flow of cooling fluid therethrough and into the chamber 246 of the fourth section 224. The fourth section 224 comprises a single chamber 246 coupled to receive the cooling fluid from both of the chambers 242*a* and 242*b* of the third section 222. Fluid passing through the chamber 246 exits the module 210.

Figure 4D:
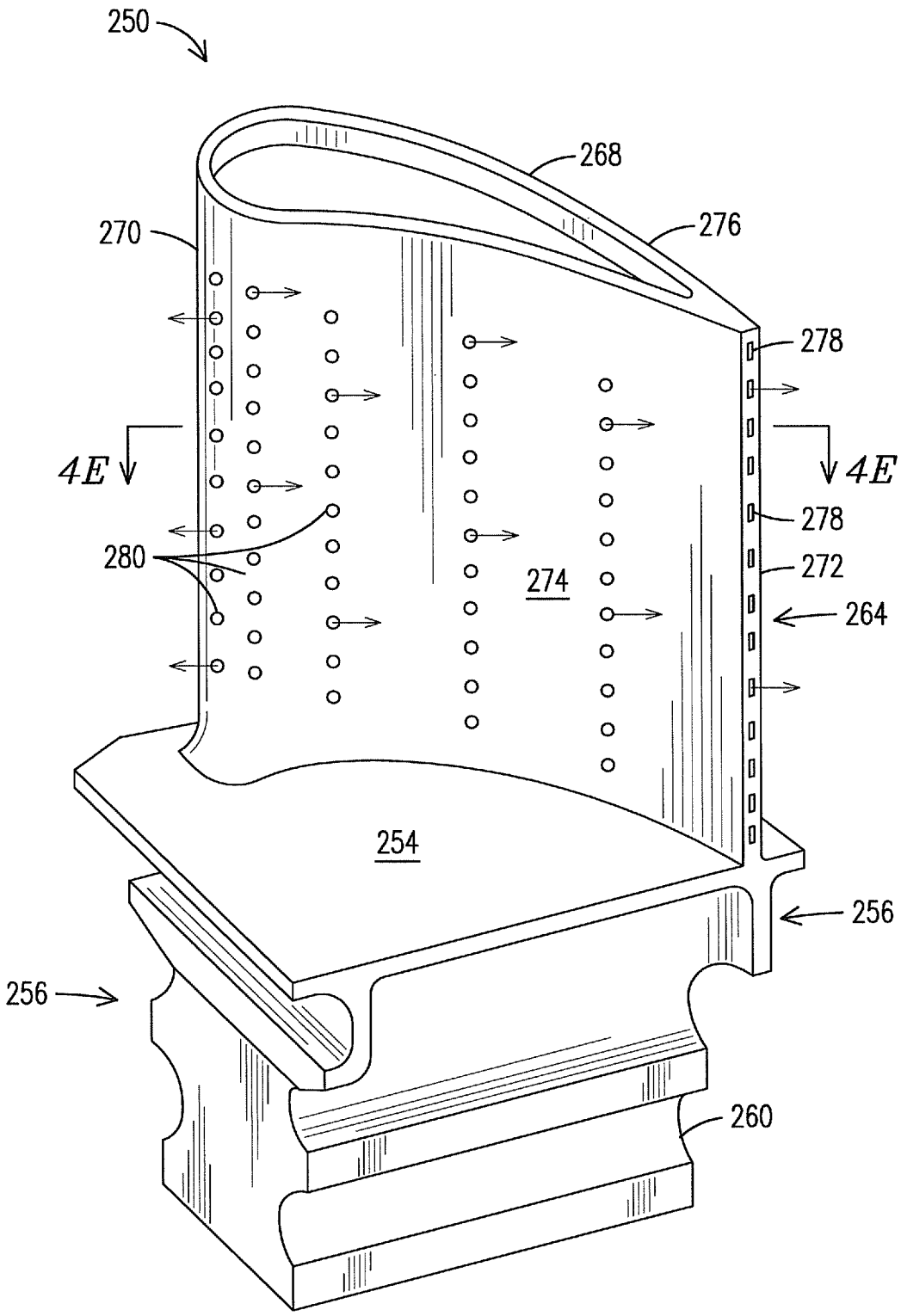
FIG. 4D is an elevation view of a turbine blade in which the array of modules shown in FIG. 4C is formed.

The rotatable turbine blade 250 shown in the view of FIG. 4D is exemplary of an airfoil incorporating the array 216 of the units 208 shown in FIG. 4C. The blade 250 includes a platform 254 formed on a base 256 beneath which is a conventional dovetail root 260. The airfoil 264 extends upward from the platform 254 to an upper end 268 near or at the top of the blade. The airfoil extends horizontally (along the plane of the platform 254) from a relatively wide leading edge region 270 to a narrow trailing edge 272. The airfoil includes a pressure side wall 274 and a suction side wall 276 opposing the pressure side wall. A series of slotted openings 278 are formed along the trailing edge 272 through which cooling fluid exits channels interior to the blade 250. A series of cooling apertures 280 are formed through the pressure and suction side walls 274 and 276 to pass cooling fluid from one or more chambers, (e.g., chamber 282 shown in FIG. 4E) and along the surface of the walls 274, 276.

Figure 4E:
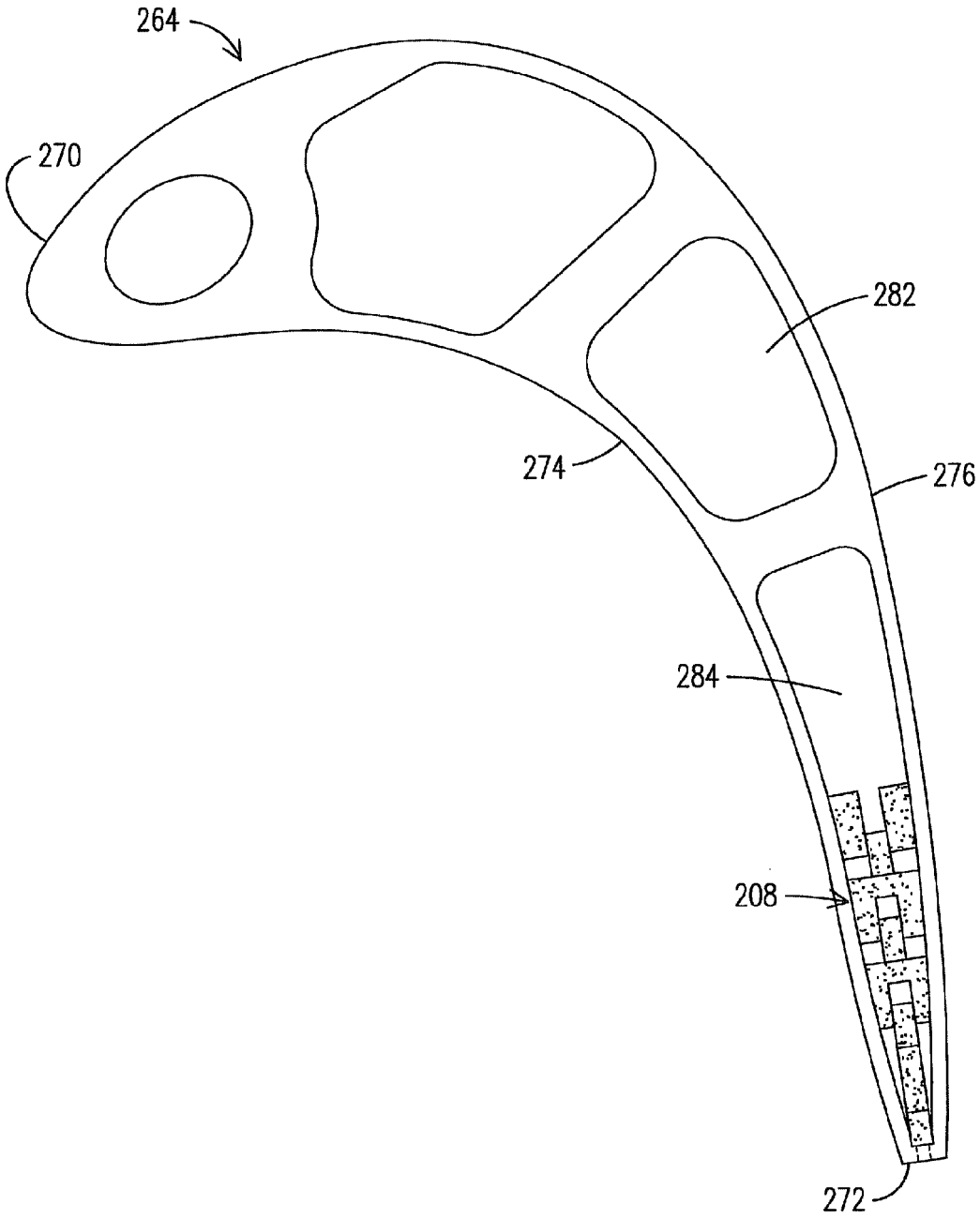
FIG. 4E is a view in cross section taken along lines 4E-4E of the airfoil shown in FIG. 4D, illustrating positioning of the module of FIG. 4A within the turbine blade of FIG. 4D.

The array 216, formed between the pressure and suction side walls 274, 276, extends as a vertical stack of the modules from above the platform 254 to near the upper end 268 at the top of the blade. FIG. 4E is a view from above of the airfoil shown in FIG. 4D taken (along lines 4E-4E), illustrating a series of conventional air chambers interior to the foil as well as a module chamber 284 in which the module array, comprising the units 208, are positioned, i.e., within the walls 274, 276 of the blade 250.

Figure 4F:
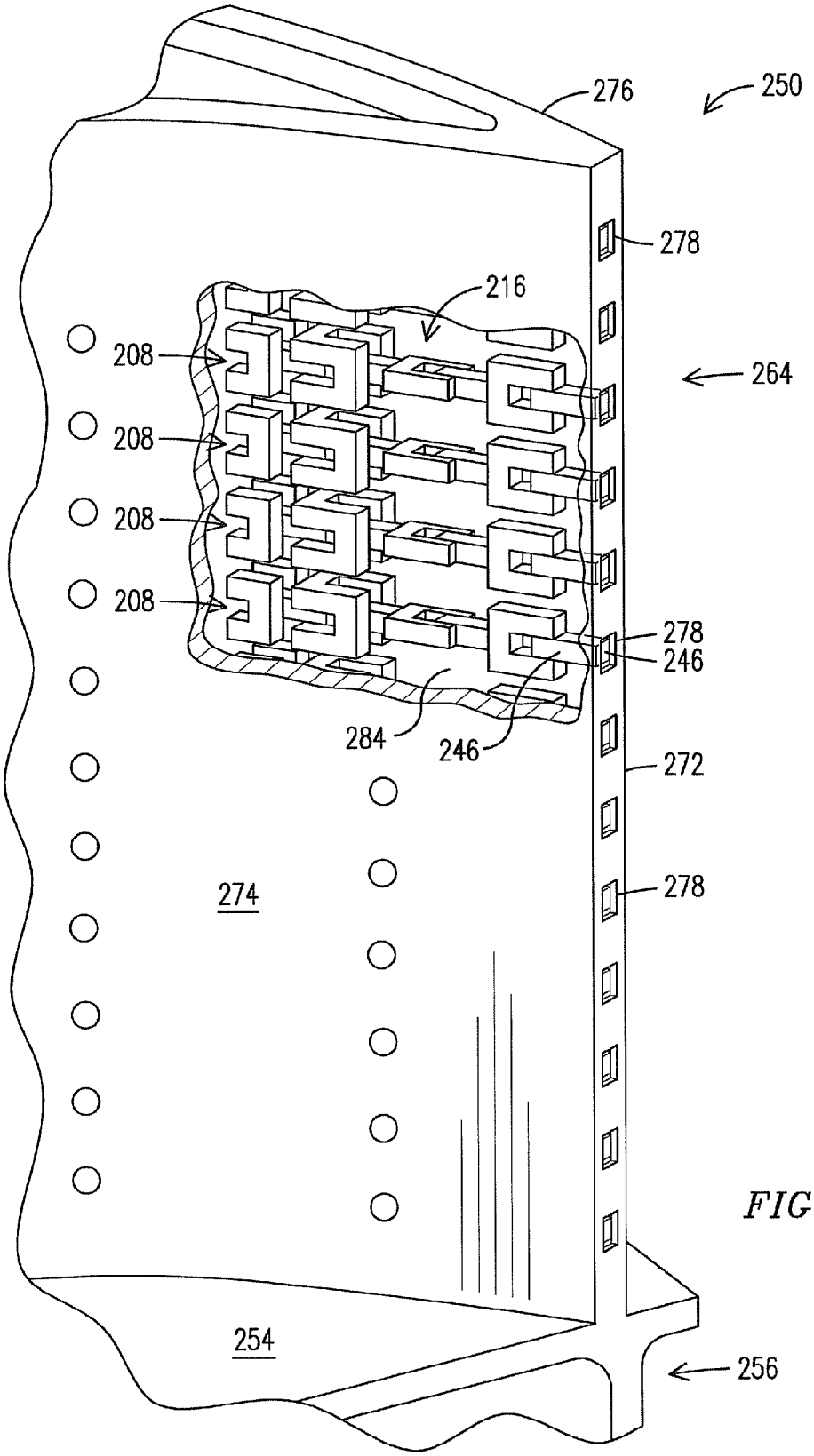
FIG. 4F is a cut-away view of a portion of the turbine blade shown in FIG. 4D.

FIG. 4F is a cut-away view of a portion of the turbine blade 250 shown in FIG. 4D. The view of FIG. 4F is taken along the pressure side wall 274 to illustrate the array 216 positioned in the module chamber 284.

While the rotatable turbine blade 250 shown in the view of FIG. 4D is exemplary of an airfoil incorporating the array 216 of the units 208 shown in FIG. 4C, it is to be understood that the inventive concepts are applicable to a variety of stationary and rotating airfoils (e.g., stator vanes and rotor blades) and the illustrated modules are also exemplary. Other module designs can be generated to provide cooling circuits to pass cooling fluid under pressure through a variety of moving and stationary components along the surfaces of which cooling is desired.

Numerous concepts and designs have been illustrated which provide cooling along a hot surface. The invention is particularly useful in applications where hot gases flow through channels, including the flow of exhaust gases through liners or transition ducts that convey hot exhaust gases from a combustion section of an engine toward a turbine section. Such a liner or transition duct is disclosed in U.S. Pat. No. 5,415,000, issued May 16, 1995, entitled "Low Nox Combustor Retro-Fit System For Gas Turbines," the entire disclosure of which is incorporated herein by reference. The conduit section 100 may also be the duct structure disclosed in U.S. application Ser. No. 11/498,479, filed Aug. 3, 2006, entitled "At Least One Combustion Apparatus and Duct Structure For a Gas Turbine Engine," by Robert J. Bland, the entire disclosure of which is incorporated herein by reference.

Numerous variations, changes and substitutions may be made without departing from the invention. Accordingly, it is intended that the invention be limited only by the scope of the claims which follow.

The invention claimed is:

1. A gas turbine system of the type having a combustor, a turbine section and a transition exhaust duct conduit providing a cylindrical path for flow of hot gas in a longitudinal direction along the direction of flow of the exhaust gas from the combustor to the turbine section, the conduit being a monolithic structure comprising a cooling arrangement disposed between a first wall and a second wall of the conduit, the cooling arrangement including a plurality of flow network units each configured to transfer heat generated by the gas turbine system to cooling fluid passing through the walls, at least a first of the network units comprising a series of interconnected flow sections each including one or more chambers, each chamber providing the network unit a flow direction in a sequence of flow directions comprising a radial direction from one of the walls toward the cylindrical path, the longitudinal direction and a circumferential direction about the cylindrical path, wherein:

at least first, second, and third ones of the flow sections connected between multiple first openings in the first wall and at least one second opening in the second wall to pass the cooling fluid through the walls, and remove heat therefrom, the first section including a first plurality of first flow paths extending between the first openings in the first wall and the second section, the first flow paths extending to the second section to effect flow of the cooling fluid between the first openings and the second section, the third section including a third plurality of third flow paths extending between the second section and the second opening in the second wall, to effect flow of the cooling fluid from the second section and through the third flow paths wherein the second section includes at least one path through a chamber extending between the first section and the third section to effect flow of the cooling fluid between the paths of the first section and the paths of the third section, the number of paths in the second section fewer than the number of paths in the first plurality of flow paths and fewer than the number of paths in the third plurality of flow paths; and so that at least the first of the network units provides a set of paths wherein cooling fluid may flow predominately in the radial direction through one set of chambers, predominately in a longitudinal direction through another set of chambers and predominately in the circumferential direction through still another set of chambers.

2. The cooling arrangement of claim 1 wherein at least the first network unit comprises a fourth flow section connected between the third flow section and the at least one second opening in the second wall of the gas turbine system, wherein the fourth section includes one or more paths extending from the third section to effect flow of the cooling fluid between the paths of the third section and the at least one second opening, the number of paths in the fourth section fewer than the first plurality of paths and fewer than the third plurality of paths.

3. The cooling arrangement of claim 1 wherein a first plurality of the network units are configured like the first network unit to receive the cooling fluid through the multiple first openings so that for each in the plurality of network units the cooling fluid travels from the multiple first openings in the first wall, then through the first section, then through the third flow paths of the third section and then out through at least the at least one second opening in the second wall.

4. The cooling arrangement of claim 3 wherein each in the plurality of network units comprises a fourth flow section connected between the first flow section and the second wall, wherein the fourth section includes one or more paths extending from the first section to effect flow of the cooling fluid between the paths of the first section and the first ports, the number of paths in the fourth section fewer than the first plurality of paths and fewer than the third plurality of paths.

5. The cooling arrangement of claim 3 wherein the cooling arrangement comprises a second plurality of flow network units each in the second plurality of network units including a fourth flow section connected between the first flow section and the second wall, wherein the fourth section includes one or more paths extending from the first section to effect flow of the cooling fluid between the paths of the first section and the first ports, the number of paths in the fourth section fewer than the first plurality of paths and fewer than the third plurality of paths.

6. The cooling arrangement of claim 4 wherein each in the plurality of network units is configured to receive the cooling fluid through the first openings so that the cooling fluid travels from the third section, then through the fourth section and then out through multiple openings in the second wall.

7. The cooling arrangement of claim 3 wherein each of the flow paths of the first, second and third sections is through a chamber and the flow path for the cooling fluid extends in a sequence comprising component flow paths in radial, longitudinal and radial directions, each direction corresponding to a direction of flow through one of the chambers or between the chambers.

8. The cooling arrangement of claim 3 wherein each of the flow paths of the first, second and third sections is through a chamber and the flow path for the cooling fluid extends in a sequence comprising component flow paths in different chambers in a sequence of radial, longitudinal, radial, longitudinal, radial, longitudinal and radial directions, each different direction in the sequence corresponding to flow through a different chamber or between the chambers.

9. The cooling arrangement of claim 3 further including a second plurality of network units wherein the network units in the second plurality are configured differently than network units in the first plurality, network units in the second plurality having at least fifth, sixth and seventh flow sections and wherein individual ones of the network units of the first plurality are combined with individual ones of the network units of the second plurality to form a plurality of module sections arranged in an array.

10. The cooling arrangement of claim 1 wherein the number of paths in the first plurality of flow paths is the same as the number of paths in the third plurality of flow paths.

11. The cooling arrangement of claim 1 wherein the number of flow paths in the first section is four, the number of paths in the second section is one and the number of flow paths in the third section is four.

12. The cooling arrangement of claim 1 wherein the number of flow paths in the first section is at least two, the number of paths in the second section is at least one and the number of flow paths in the third section is at least two.

* * * * *